US006994754B2

(12) United States Patent
Dauchelle et al.

(10) Patent No.: US 6,994,754 B2
(45) Date of Patent: Feb. 7, 2006

(54) METHOD AND INSTALLATION FOR DIP COATING OF A METAL STRIP, IN PARTICULAR A STEEL STRIP

(75) Inventors: Didier Dauchelle, Creil (FR); Hugues Baudin, Teteghem (FR); Patrice Lucas, Lyons (FR); Laurent Gacher, Sarreguemines (FR); Yves Prigent, Roberval (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 10/416,191

(22) PCT Filed: Nov. 6, 2001

(86) PCT No.: PCT/FR01/03437

§ 371 (c)(1),
(2), (4) Date: Oct. 21, 2003

(87) PCT Pub. No.: WO02/38822

PCT Pub. Date: May 16, 2002

(65) Prior Publication Data

US 2004/0052960 A1 Mar. 18, 2004

(30) Foreign Application Priority Data

Nov. 10, 2000 (FR) ..... 00 14483

(51) Int. Cl.
*B05C 3/00* (2006.01)
*B05D 1/18* (2006.01)

(52) U.S. Cl. ..... 118/429; 118/424; 118/400; 427/435; 427/436

(58) Field of Classification Search ..... 427/431, 427/432, 433, 434.2, 434.5, 435, 436, 443.2; 118/419, 423, 429

See application file for complete search history.

(56) References Cited

U.S. PATENT DOCUMENTS 5,069,158 A * 12/1991 Rey ..... 118/410

FOREIGN PATENT DOCUMENTS

| | | | |
|---|---|---|---|
| GB | 486 584 | | 6/1938 |
| JP | 6-17214 A | * | 1/1994 |
| JP | 06128711 A | * | 5/1994 |

OTHER PUBLICATIONS

JPO computer translation of JP 6-17214 A, published Jan. 1994.*

Patent Abstracts of Japan, vol. 18, No. 226, Apr. 25, 1994 & JP 06 07214, Jan. 25, 1994.

Patent Abstracts of Japan, vol.. 2000, No. 14, Feb. 5, 2001 & JP 2000 273603, Oct. 3, 2000.

* cited by examiner

*Primary Examiner*—Timothy Meeks
*Assistant Examiner*—David Turocy
(74) *Attorney, Agent, or Firm*—Sughrue Mion, PLLC

(57) ABSTRACT

A process for the continuous dip-coating of a metal strip (1) in a tank (11) containing a liquid metal bath (12), in which process the metal strip (1) is made to run continuously through a duct (13), the lower part of which is immersed in the liquid metal bath (12), in order to define with the surface of the bath a liquid seal (14). In the region where the strip (1) leaves the liquid metal bath (12), the liquid metal is isolated from the surface of the bath in an isolating enclosure (20), and the metal oxide particles and intermetallic compound particles are recovered by the liquid metal flowing from this region into the enclosure (20), and the particles are extracted from this enclosure (20). Also, a plant for implementing the process.

2 Claims, 4 Drawing Sheets

METHOD AND INSTALLATION FOR DIP COATING OF A METAL STRIP, IN PARTICULAR A STEEL STRIP

BACKGROUND OF THE INVENTION

The present invention relates to a process and a plant for the continuous hot dip-coating of a metal strip, especially a steel strip.

In many industrial applications, steel sheet is used which is coated with a protective layer, for example for corrosion protection, and usually coated with a zinc layer.

This type of sheet is used in various industries to produce all kinds of parts, in particular visual parts.

To obtain this kind of sheet, continuous dip-coating plants are used in which a steel strip is immersed in a bath of molten metal, for example zinc, which may contain other chemical elements, such as aluminium and iron, and possible addition elements such as, for example, lead, antimony, etc. The temperature of the bath depends on the nature of the metal, and in the case of zinc the temperature of the bath is around 460° C.

In the particular case of hot galvanising, as the steel strip runs through the molten zinc bath, an Fe—Zn—Al intermetallic alloy with a thickness of a few tens of nanometres forms on the surface of the said strip.

The corrosion resistance of the parts thus coated is provided by the zinc, the thickness of which is controlled usually by air wiping. The adhesion of the zinc to the metal strip is provided by the layer of the aforementioned intermetallic alloy.

Before the steel strip passes through the molten metal bath, this steel strip firstly runs through an annealing furnace in a reducing atmosphere where the purpose is to recrystallise it after the substantial work hardening resulting from the cold-rolling operation and to prepare its surface chemical state so as to favour the chemical reactions necessary for the actual dip-coating operation. The steel strip is heated to about 650 to 900° C. depending on the grade, for the time needed for recrytallisation and surface preparation. It is then cooled to a temperature close to that of the bath of molten metal by means of heat exchangers.

After it has passed through the annealing furnace, the steel strip runs through a duct, also called a "snout", containing an atmosphere which protects the steel, and is immersed in the bath of molten metal.

The lower part of the duct is immersed in the bath of metal in order to define, with the surface of the said bath and inside this duct, a liquid seal through which the steel sheet passes as it runs through the said duct.

The steel strip is deflected by a roller immersed in the zinc bath. It emerges from this metal bath and then passes through wiping means used to regulate the thickness of the liquid metal coating on this steel strip.

At the moment when the strip is extracted from the bath, it passes through the surface of the zinc bath, which is covered with zinc oxide and with dross coming from the steel strip dissolution reaction.

To prevent the particles from being entrained by the strip, the surface of the bath, accessible by the operators, is periodically cleaned in such a way that the strip does not entrain particles.

However, this manual cleaning procedure does not permanently guarantee the cleanliness of the surface of the bath and the absence of particles periodically rising from the bath to the point where the steel strip is extracted.

Thus, the coated steel strip has visual defects which are magnified or revealed during the zinc wiping operation.

This is because the foreign particles are retained by the air wiping jets before the said particles are ejected or broken up, thus creating streaks of lesser thickness in the liquid zinc having a length ranging from a few millimetres to a few centimetres.

One solution for avoiding these drawbacks consists in cleaning the surface of the liquid seal by pumping off the zinc oxides and dross coming from the bath.

These pumping operations allow the surface of the liquid seal to be cleaned only very locally at the point of pumping and their effectiveness and range of action are very low, which does not guarantee that in particular the region where the steel strip leaves the liquid zinc bath is completely cleaned.

SUMMARY OF THE INVENTION

The object of the invention is to provide a process and a plant for the continuous dip-coating of a metal strip which make it possible to avoid the abovementioned drawbacks and to achieve a very low density of defects required by customers desiring surfaces free of visual defects.

The subject of the invention is a process for the continuous dip-coating of a metal strip in a tank containing a liquid metal bath, in which process the metal strip is made to run continuously, in a protective atmosphere, through a duct, the lower part of which is immersed in the liquid metal bath in order to define with the surface of the said bath, and inside this duct, a liquid seal, the metal strip is deflected around a deflector roller placed in the metal bath and the coated metal strip is wiped on leaving the metal bath, characterised in that, in the region where the strip leaves the liquid metal bath, the liquid metal is isolated from the surface of the said bath in an isolating enclosure and the metal oxide particles and intermetallic compound particles are recovered by the liquid metal flowing from this region into the said enclosure, the drop in height of the liquid metal in this enclosure being determined in order to prevent metal oxide particles and intermetallic compound particles from rising as a countercurrent to the flow of liquid metal, and the said particles are extracted from this enclosure.

The subject of the invention is also a plant for the continuous hot dip-coating of a metal strip, of the type comprising:

- a tank containing a liquid metal bath,
- a duct through which the metal strip in a protective atmosphere runs and the lower part of which duct is immersed in the liquid metal bath in order to define with the surface of the said bath, and inside this duct, a liquid seal,
- a roller, placed in the metal bath, for deflecting the metal strip and
- means for wiping the coated metal strip on leaving the metal bath, characterised in that it comprises, on the one hand, in the region where the strip leaves the liquid metal bath, an enclosure for isolating the liquid metal in this region with respect to the surface of the bath and for recovering the metal oxide particles and intermetallic compound particles by the liquid metal flowing from this region into the said enclosure, the drop in height of the liquid metal in the enclosure is greater than 50 mm in order to prevent the metal oxide particles and intermetallic compound particles from rising as a countercurrent to the flow of liquid metal and, on the other hand, means for extracting the said particles from this enclosure.

According to other features of the invention:

- the drop in height of the liquid metal in the enclosure is greater than 100 mm;
- the enclosure surrounds the metal strip and has a bottom and two concentric walls making between them a compartment and defining, in the upper part of the said enclosure, an opening, the upper edge of the external wall being positioned above the surface of the liquid metal bath and the upper edge of the internal wall being positioned below the said surface;
- the internal wall of the enclosure has a lower part flared out towards the bottom of the tank and an upper part parallel to the metal strip;
- the means for extracting the particles are formed by a pump connected, on the suction side, to the compartment of the enclosure via a connecting pipe and provided, on the delivery side, with a pipe for discharging the withdrawn liquid metal towards the rear of the tank;
- the plant includes means for positioning the metal strip with respect to the upper edge of the internal wall of the enclosure.

BRIEF DESCRIPTION OF THE DRAWINGS

Further features and advantages of the invention will become apparent from the description which follows, given by way of example, with reference to the appended drawings in which.

DETAILED DESCRIPTION OF THE INVENTION

In the following, a description will be given in the case of a plant for the continuous galvanising of a metal strip. However, the invention applies to any continuous dip-coating process in which surface pollution may occur and for which a clean liquid seal must be maintained.

Firstly, on leaving the cold-rolling mill train, the steel strip 1 passes, in a reducing atmosphere, through an annealing furnace (not shown) for the purpose of recrystallising it after the substantial work hardening resulting from the cold rolling, and to prepare its chemical surface state so as to favour the chemical reactions needed for the galvanising operation.

The steel strip is heated in this furnace to a temperature of between, for example, 650 and 900° C.

Figure 1:
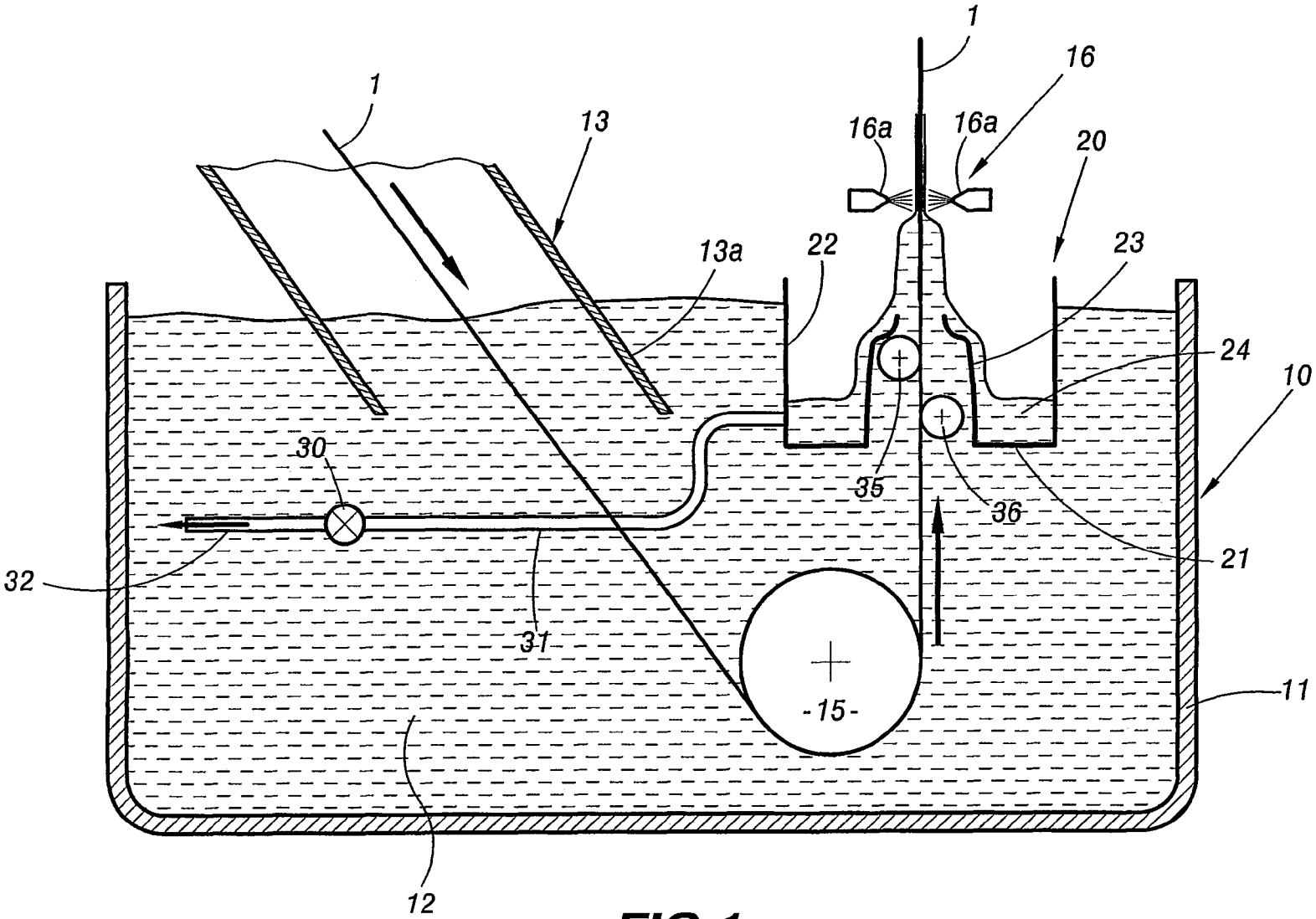
FIG. 1 is a schematic side view of a continuous dip-coating plant according to the invention.

On leaving the annealing furnace, the steel strip 1 passes through a galvanising plant, shown in FIG. 1 and denoted by the overall reference 10.

This plant 10 comprises a tank 11 containing a bath 12 of liquid zinc which contain s chemical elements such as aluminium and iron and possible additional elements such as lead, antimony etc.

The temperature of this liquid zinc bath is around 460° C.

On leaving the annealing furnace, the steel strip 1 is cooled to a temperature close to that of the liquid zinc bath by means of heat exchangers and is then immersed in the liquid zinc bath 12.

As shown in FIG. 1, the galvanising plant 10 includes a duct 13 within which the steel strip 1 runs in an atmosphere which protects the steel.

This duct 13, also called "snout", has, in the illustrative example shown in the figures, a rectangular cross-section.

The lower part 13*a* of the duct 13 is immersed in the zinc bath 12 so as to define with the surface of the said bath 12, and inside this duct 13, a liquid seal 14.

Thus, the steel strip 1 on being immersed in the liquid zinc bath 12 passes through the surface of liquid seal 14 in the lower part 13*a* of the duct 13.

The steel strip 1 is deflected by a roller 15, usually called the bottom roller, placed in the zinc bath 12 and, on leaving this zinc bath 12, the coated steel strip 1 passes through wiping means 16 which consist, for example, of air spray nozzles 16*a* and which are directed towards each side of the steel strip 1 in order to regulate the thickness of the liquid zinc coating.

Figure 2:
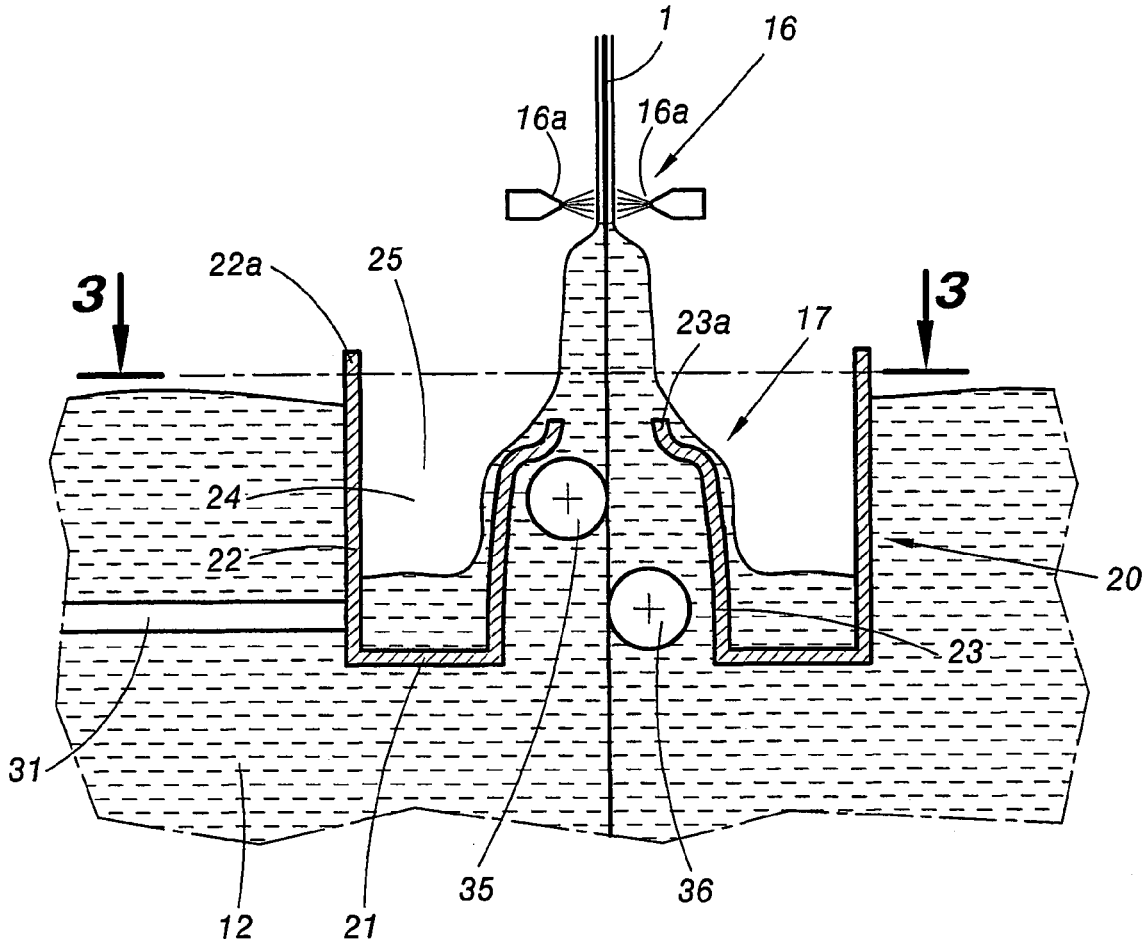
FIG. 2 is a view on a larger scale of the enclosure placed at the point where the strip leaves the galvanizing plant, according to the invention.
Figure 3:
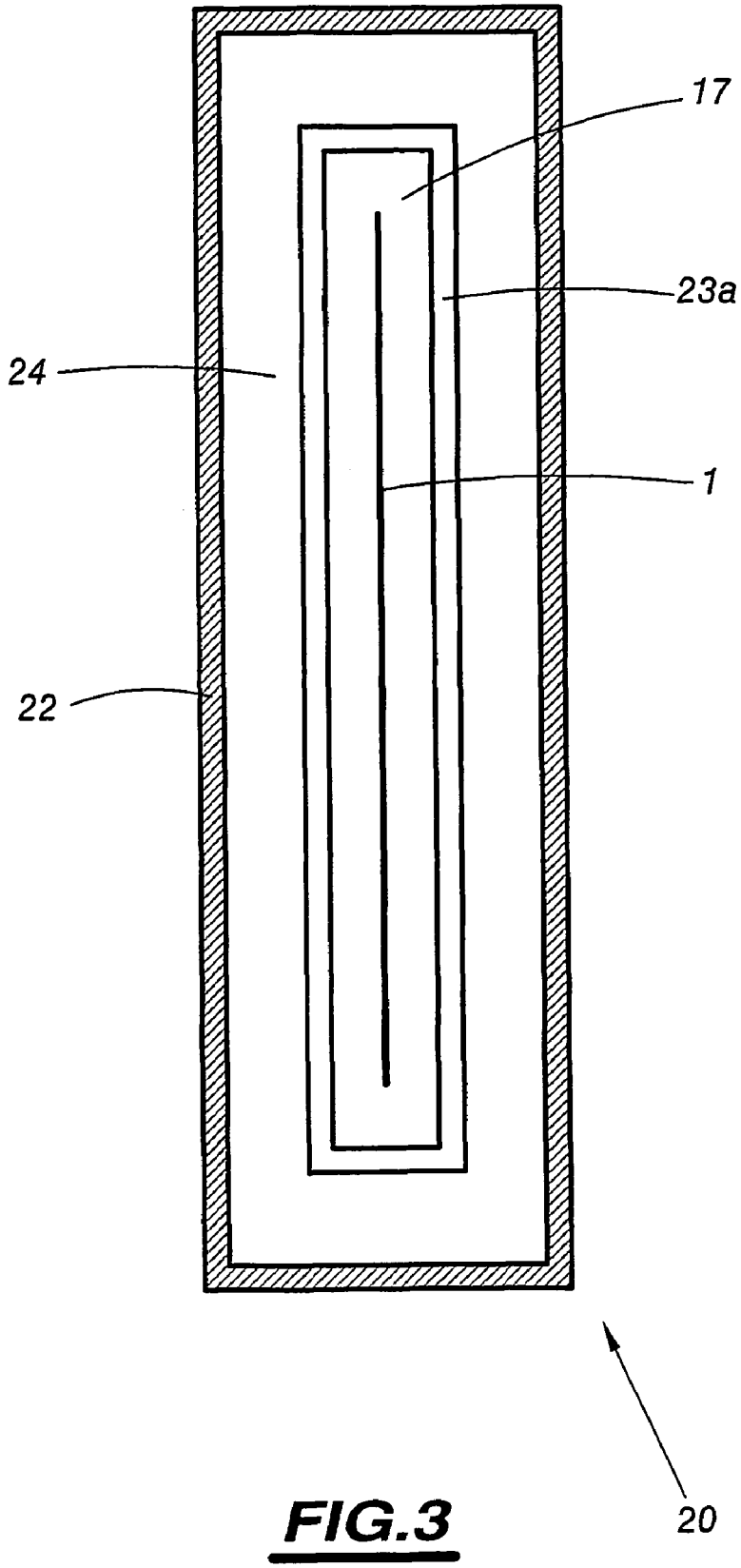
FIG. 3 is a sectional view on the line 3—3 in FIG. 2.

Thus, as shown in FIGS. 1 and 2, the plant includes, in the region 17 where the strip 1 leaves the liquid zinc bath 12, an enclosure 20 for isolating the liquid zinc in this region 17 with respect to the surface of the bath 12 and for recovering the zinc oxide particles and intermetallic compound particles by the liquid zinc flowing from this region 17 into the said enclosure 20, as will be seen later.

The enclosure 20 surrounds the metal strip 1 and has a bottom 21 and two concentric walls, an external wall 22 and an internal wall 23 respectively, making between them a compartment 24. The walls 22 and 23 define, in the upper part of the enclosure 20, an opening 25.

As shown in FIG. 2, the upper edge 22*a* of the external wall 22 is positioned above the surface of the liquid zinc bath 12 and the upper edge 23*a* of the internal wall 23 is positioned below this surface.

The drop in height of the liquid metal in the enclosure (20) is determined in order to prevent the metal oxide particles and intermetallic compound particles from rising as a countercurrent to the flow of liquid metal and this drop is greater than 50 mm and preferably 100.

Preferably, the internal wall 23 has a lower part flared out towards the bottom of the tank 11. The walls 22 and 23 of the enclosure 20 are made of stainless steel and have a thickness of between 10 and 20 mm for example.

Figure 4:
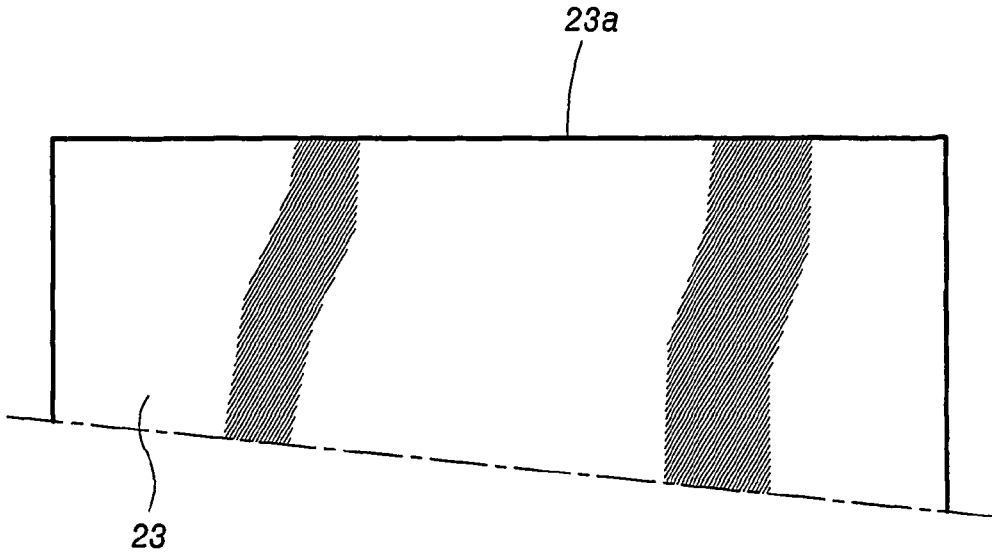
FIG. 4 is a schematic side view of a first embodiment of the upper edge of the internal wall of the enclosure.

According to a first embodiment, shown in FIG. 4, the upper edge 23*a* of the internal wall 23 is straight and preferably tapered.

Figure 5:
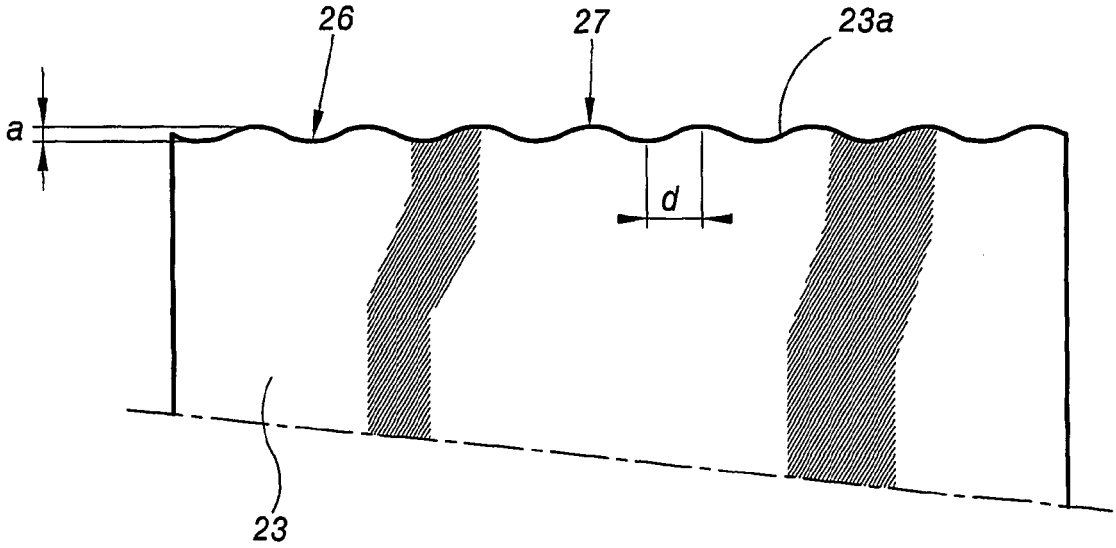
FIG. 5 is a schematic side view of a second embodiment of the upper edge of the internal wall of the enclosure.

According to a second embodiment, shown in FIG. 5, the upper edge 23*a* of the internal wall 23 of the enclosure 20 comprises, in the longitudinal direction, a succession of hollows 26 and projections 27.

The hollows 26 and the projections 27 are in the form of circular arcs and the difference in height "a" between the said hollows and the said projections is preferably between 5 and 10 mm. In addition, the distance "d" between the hollows 26 and the projections 27 is, for example, of the order of 150 mm.

Again in this embodiment, the upper edge 23 of the internal wall 23 is preferably tapered.

As shown in FIG. 1, the plant also includes means for extracting the particles collected in the compartment 24 of the enclosure 20.

These extraction means are formed by a pump 30 connected, on the suction side, to the compartment 24 via a connecting pipe 31 and provided, on the delivery side, with a pipe 32 for discharging the withdrawn zinc into the volume of the bath 12.

Moreover, the plant includes means for positioning the steel strip 1 with respect to the upper edge 23*a* of the internal wall 23, which positioning means consist of two horizontal collers 35 and 36 placed on each side of the strip and offset with respect to each other.

In general, the steel strip 1 penetrates the zinc bath 12 via the duct 13 and the liquid seal 14, and this strip entrains the zinc oxide particles and intermetallic compound particles coming from the bath, thus creating visual defects in the coating.

These particles, in supersaturation in the liquid zinc bath 12, have a lower density than that of liquid zinc which rises to the surface of this bath and especially in the region 17 where the strip leaves.

Thus, at the moment of extraction of the strip 1, on leaving the liquid zinc bath 12, this steel strip passes through the region 17 which is covered with zinc oxide and intermetallic compound particles.

To avoid this drawback, the region 17 where the steel strip 1 leaves is reduced by the internal wall 23 of the enclosure 20 which surrounds the steel strip 1 and the surface of the liquid zinc isolated in this region 17 flows into the compartment 24 of the enclosure 20, passing over the upper edge 23*a* of the internal wall 23 of the said enclosure 20.

The particles which float on the surface of the liquid zinc region 17 and which are the cause of visual defects are entrained into the compartment 24 of the enclosure 20 and the liquid zinc contained in this compartment 24 is pumped so as to maintain a depressed level sufficient to allow the natural flow of the zinc from this region 17 towards this compartment 24.

In this way, the free surface of the region 17 where the coated steel strip 1 leaves is isolated by the internal wall 23 of the enclosure 20 and this liquid zinc surface is permanently replenished and the liquid zinc sucked up by the pump 30 from the compartment 24 is injected into the zinc bath 12 at the rear of the tank 11 by the discharge pipe 32.

By means of the effect thus created, the coated steel strip runs, on leaving the liquid zinc bath 12, through a permanently cleaned surface of liquid zinc and emerges from this zinc bath with the minimum of defects.

The flow of zinc into the compartment 24 of the enclosure 20 is adjusted by raising the level of the zinc bath 12 by putting zinc ingots into the tank 11.

According to a variant, the flow of zinc into the compartment 24 may be adjusted by varying the vertical position of the enclosure 20 with respect to the surface of the zinc bath 12. For this purpose, this enclosure 20 may be fitted with height adjustment means for adjusting its vertical position. These means consist, for example, of at least one hydraulic or pneumatic cylinder or any other suitable component.

When the level decreases in the compartment 24, this corresponds to a slight reduction in the amount of zinc flowing into this compartment 24 and therefore in the level of zinc in the region 17.

This reduction is due to the zinc consumed by the steel strip 1 and by the skimming of the surface of the zinc bath 12.

By virtue of the plant according to the invention, the density of defects on the coated surfaces of the steel strip is substantially reduced and the surface quality thus obtained of this coating meets the criteria required by customers desiring parts whose surfaces are free of visual defects.

The invention applies to any metal dip-coating process.

What is claimed is:

1. A plant for the continuous hot dip-coating of a metal strip (1), of the type comprising:

a tank (11) containing a liquid metal bath (12), a duct (13) through which the metal strip (1) in a protective atmosphere runs and a lower part (13*a*) of which duct (13) is immersed in the liquid metal bath (12) in order to define with the surface of said bath, and inside this duct, a liquid seal (14), a roller (15), placed in the metal bath (12), for deflecting the metal strip (1), and means (16) for wiping the coated metal strip (1) on leaving the metal bath (12), characterised in that said plant further comprises, on the one hand, in a region (17) where the strip (1) leaves the liquid metal bath (12), an enclosure (20) for isolating the liquid metal in this region (17) with respect to the surface of the bath (12) and for recovering metal oxide particles and intermetallic compound particles by the liquid metal flowing from this region (17) into the enclosure (20), wherein the drop in height of the liquid metal (12) in the enclosure (20) is greater than 50 mm in order to prevent the metal oxide particles and intermetallic compound particles from rising as a countercurrent to the flow of liquid metal, and, on the other hand, means (30) for extracting the particles from this enclosure (20), said plant being further characterized:

in that the enclosure (20) surrounds the metal strip (1) and has a bottom (21) and two concentric walls (22,23) making between them a compartment (24) and defining, in an upper part of the enclosure (20), an opening (25), and an upper edge (22*a*) of an external one of the concentric walls (22) being positioned above the surface of the liquid metal bath (12), and an upper edge (23*a*) of an internal one (23) of the concentric walls being positioned below said surface; and by means (35, 36) for positioning the metal strip (1) with respect to the upper edge (23*a*) of the internal wall (23) of the enclosure (20), wherein the upper edge (23*a*) of the internal wall (23) of the enclosure (20) comprises, in the longitudinal direction, a succession of hollows (26) and projections (27), wherein the difference in height between the hollows (26) and the projections (27) is between 5 and 10 mm.

2. Plant according to claim 1, characterised in that the distance between the hollows (26) and the projections (27) is of the order of 150 mm.

* * * * *